US006863284B2

(12) United States Patent
Wegener

(10) Patent No.: US 6,863,284 B2
(45) Date of Patent: Mar. 8, 2005

(54) IN-LINE SKATE ASSEMBLY WITH BACKSLIDE PLATE

(76) Inventor: Andreas C. Wegener, 3204 Rim Rock Cir., Encinitas, CA (US) 92024

( * ) Notice: Subject to any disclaimer, the term of this patent is extended or adjusted under 35 U.S.C. 154(b) by 19 days.

(21) Appl. No.: 10/200,375

(22) Filed: Jul. 19, 2002

(65) Prior Publication Data

US 2004/0012188 A1 Jan. 22, 2004

(51) Int. Cl.[7] ..... A63C 1/02

(52) U.S. Cl. ..... 280/11.231; 280/11.3; 280/811

(58) Field of Search ..... 280/11.19, 11.12, 280/811, 11.3, 11.32, 809, 7.13; 36/115, 114, 132, 72 A, 72 R, 107, 116

(56) References Cited

U.S. PATENT DOCUMENTS

| | | | | | |
|---|---|---|---|---|---|
| 250,319 | A | | 11/1881 | Yates | |
| 4,273,345 | A | | 6/1981 | Ben-Dor et al. | |
| 4,928,982 | A | | 5/1990 | Logan | |
| 5,183,276 | A | | 2/1993 | Pratt | |
| 5,234,230 | A | | 8/1993 | Crane et al. | |
| 5,327,329 | A | | 7/1994 | Stiles | |
| 5,411,278 | A | | 5/1995 | Wittmann | |
| 5,456,478 | A | | 10/1995 | Hsu et al. | |
| 5,566,958 | A | | 10/1996 | Sinelnikov et al. | |
| 5,772,220 | A | | 6/1998 | Gaster | |
| 5,970,631 | A | * | 10/1999 | Inman | 36/115 |
| 6,006,450 | A | | 12/1999 | Hayes | |
| 6,029,983 | A | | 2/2000 | Wegener | |
| 6,041,525 | A | | 3/2000 | Kelley | |
| 6,070,886 | A | * | 6/2000 | Cornelius et al. | 280/11.223 |
| 6,115,946 | A | * | 9/2000 | Morris et al. | 36/115 |
| 6,151,806 | A | * | 11/2000 | Morris et al. | 36/136 |
| 6,158,150 | A | * | 12/2000 | Morris et al. | 36/115 |
| 6,164,669 | A | * | 12/2000 | Svensson | 280/11.3 |
| 6,195,918 | B1 | * | 3/2001 | Kelley et al. | 36/115 |
| 6,195,920 | B1 | * | 3/2001 | Morris et al. | 36/132 |
| 6,226,900 | B1 | * | 5/2001 | Mazars | 36/132 |
| 6,247,251 | B1 | | 6/2001 | James | |
| 6,467,198 | B1 | * | 10/2002 | James | 36/115 |
| 6,648,346 | B2 | * | 11/2003 | Borel | 280/11.3 |

* cited by examiner

*Primary Examiner*—Christopher P. Ellis
*Assistant Examiner*—Bridget Avery
(74) *Attorney, Agent, or Firm*—Gordon & Rees LLP

(57) ABSTRACT

An backslide plate is designed for mating engagement in an opening in the outer side face of an in-line skate boot. The backslide plate has an arcuate outer slide guiding surface for contacting a sliding surface during sliding maneuvers. The plate is releasably secured in the boot opening by a releasable fastener device. In this way, the skater's foot will be in direct engagement with the backslide plate during maneuvers, providing improved control.

14 Claims, 3 Drawing Sheets

IN-LINE SKATE ASSEMBLY WITH BACKSLIDE PLATE

BACKGROUND OF THE INVENTION

The present invention relates generally to single track or in-line roller skates, and is particularly concerned with a backslide plate assembly for in-line skates.

In-line roller skates or roller blades typically have four to five wheels arranged one after the other in a line in the running direction, and the wheels are rotatably mounted on a chassis or frame which in turn is connected to the sole of a shoe or other footwear. Some skaters perform stunts or maneuvers on such skates, for example stunts known as backslides in which a skater slides along on a railing, curbstone edge or the like. In performing these maneuvers, the skater will use the outside of one of the shoes or boots as a sliding surface, so that the shoe or boot becomes worn out quickly.

In my previous U.S. Pat. No. 6,029,983 entitled Backslide Plate, a replaceable slider is placed at the exposed areas of a skater's shoe to protect those areas against wear when performing sliding stunts. The slider is designed to completely cover the shoe in the sliding area. The slider is attached around the outer contour of the shoe and has an arcuate surface for added guidance to the skater during sliding.

SUMMARY OF THE INVENTION

It is an object of the present invention to provide a new and improved backslide plate assembly for in-line roller skates.

According to one aspect of the present invention, an in-line skate assembly is provided which comprises a boot having a sole, a heel, a toe, and opposite inner and outer side faces, the boot having an opening in its outer side face extending from the outer side face partially into the sole, and a backslide plate for mating engagement in the boot opening, the backslide plate having an outer slide guiding surface for contacting a sliding surface during sliding maneuvers.

The boot may be designed for direct connection to a wheel carrying frame or chassis of an in-line skate, or the assembly may also include a separate sole plate which is releasably fastened to the sole of the boot. In the latter case, the sole plate also has a cut out for receiving a lower portion of the backslide plate. A suitable fastener is provided for releasably securing the backslide plate in the boot opening, to allow the plate to be removed and replaced when worn. In another embodiment, the one piece sole plate is replaced by two separate grind plates secured to the sole of the boot on opposite sides of the backslide plate, and two separate grind plates secured to the sole of the boot along the inside edge.

One advantage of this invention is that the opening in the side of the boot allows a more direct contact between the backslide plate and foot of the wearer, since the distance between the foot and the sliding surface is decreased. This provides the skater with a more direct feel during the sliding maneuver, as well as more direct control of the sliding movement.

According to another aspect of the present invention, a backslide plate for securing in an opening in a skate boot is provided, which comprises a plate member having first and second generally perpendicular legs for fitting in an opening cut into a skater's boot at the junction between an outer side face and sole of the boot, the first leg having an outer face with a portion which is substantially flush with the outer side face of the boot when the plate is fitted in the opening, the second leg having an outer face with a portion which faces downwardly adjacent the sole of the boot when fitted in the opening, and the plate member having an outwardly facing, smooth, concave arcuate sliding surface portion extending across the junction between the two outer faces for forming a sliding surface for performing sliding or grinding maneuvers.

A suitable fastener opening is proved for securing the backslide plate in the boot opening. In an exemplary embodiment, the plate member has an extended flange for extending under the sole of the boot adjacent the opening, and the flange and sole have aligned openings for receiving a suitable fastener bolt.

This invention provides a replaceable backslide plate of more durable, harder material than the boot to reduce or avoid wear of the boot itself when the skater performs stunts and sliding maneuvers. By mounting the plate in a recessed opening in the outer surface and sole of the boot, the distance between the skater's foot and the slide surface is decreased. Also, the skater's foot will have more direct contact with the slide surface and will have increased control and better, more direct feel for performing stunts and sliding maneuvers.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
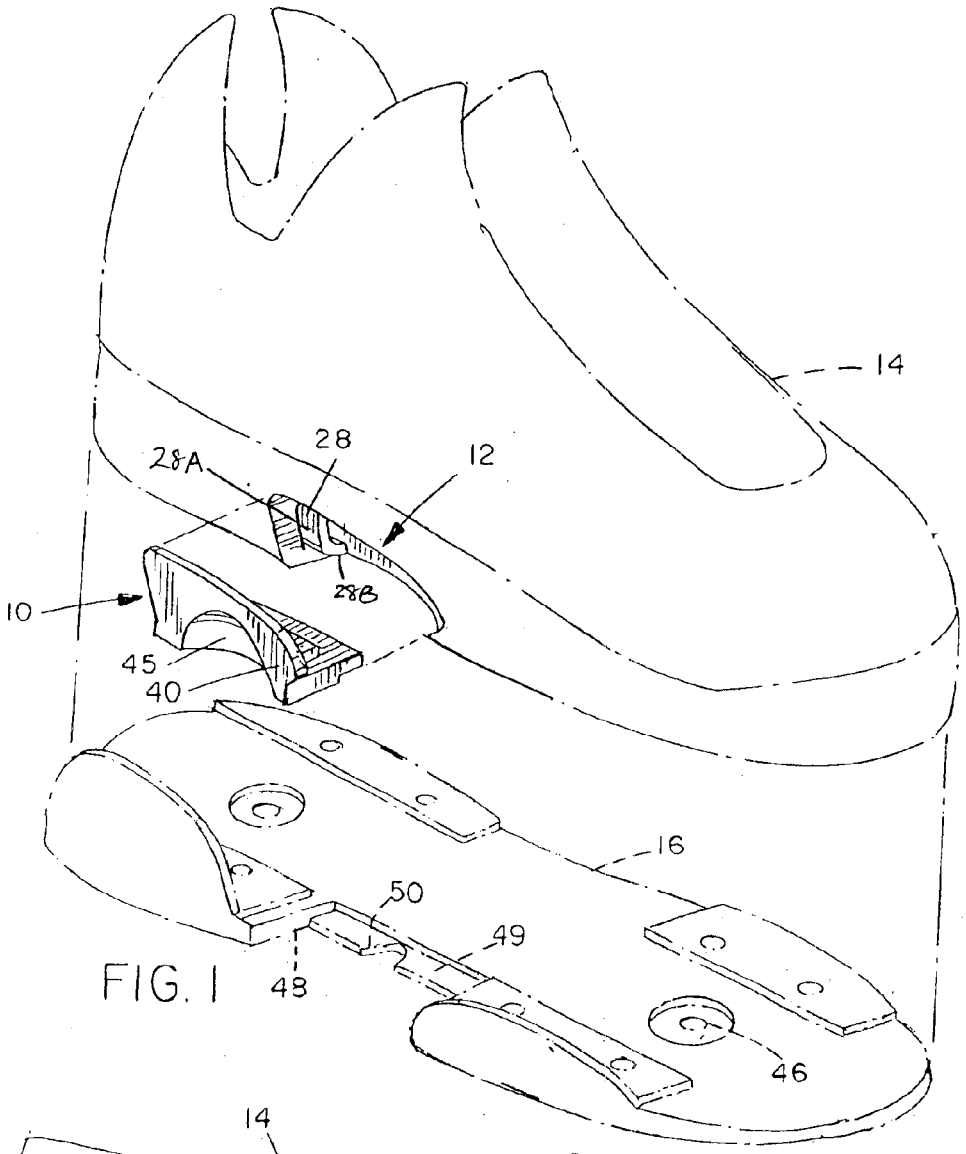
FIG. 1 is a perspective view, with the components separated, showing a typical skate boot with a backslide plate assembly according to an exemplary embodiment of the invention.
Figure 2:
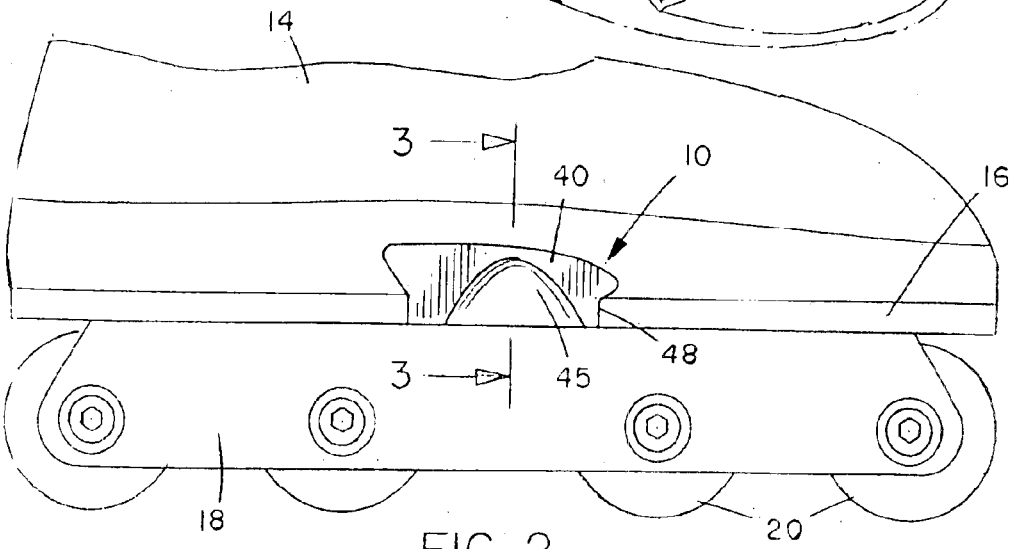
FIG. 2 is a side view of the assembled boot components.
Figure 6:
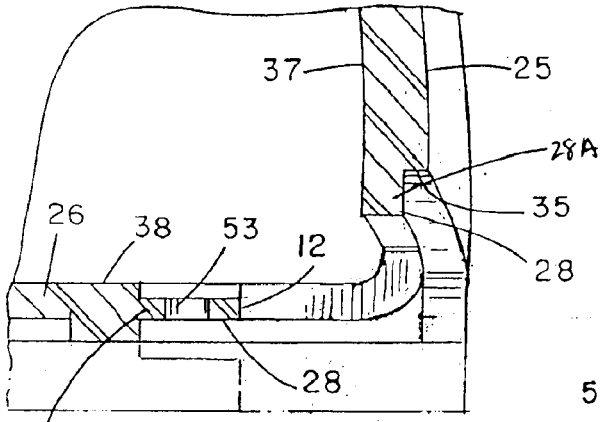
FIG. 6 is an enlarged sectional view taken on line 6—6 of FIG. 5.
Figure 7:
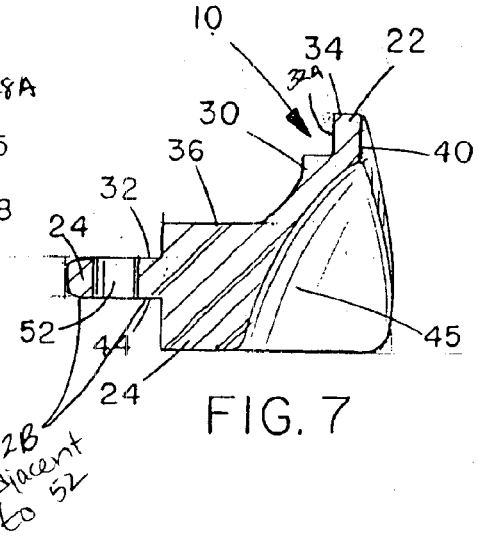
FIG. 7 is an enlarged view of the backside plate as shown in section in FIG. 3.
Figure 8:
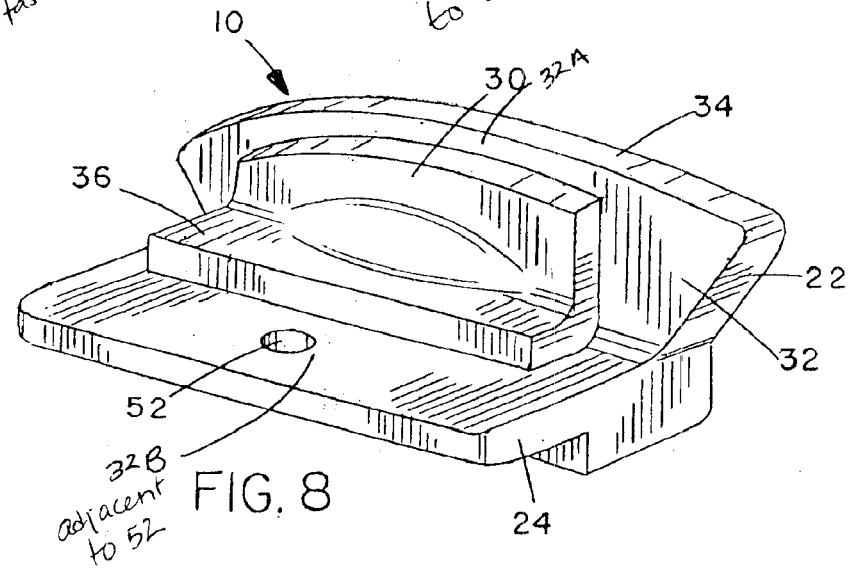
FIG. 8 is a perspective view of the inner side of the backside plate.

FIGS. 1 to 7 of the drawings illustrate an in-line skate assembly with a backside plate according to an exemplary embodiment of the invention, while FIGS. 7 and 8 illustrate the backslide plate 10 alone. As best illustrated in FIGS. 1, 3, 6 and 7, the backslide plate 10 is designed for fitting into a recessed opening 12 in the outer face of a boot 14 forming part of an in-line skate, and is secured between the sole 26 of the boot and a rigid sole plate 16 secured to the sole of the boot. The sole plate 16 is secured to a downwardly depending frame 18 on which a row of wheels or rollers 20 is rotatably mounted in a manner known in the field, as illustrated in FIG. 2. However, in alternative embodiments, the sole of the boot may be directly secured to frame 18 without a separate sole plate.

Figure 3:
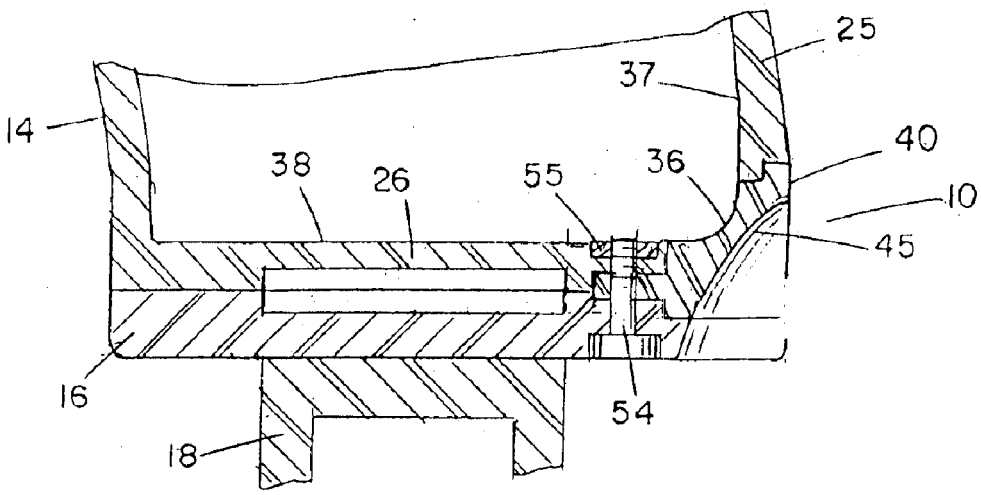
FIG. 3 is an enlarged sectional view taken on line 3—3 of FIG. 2.
Figure 4:
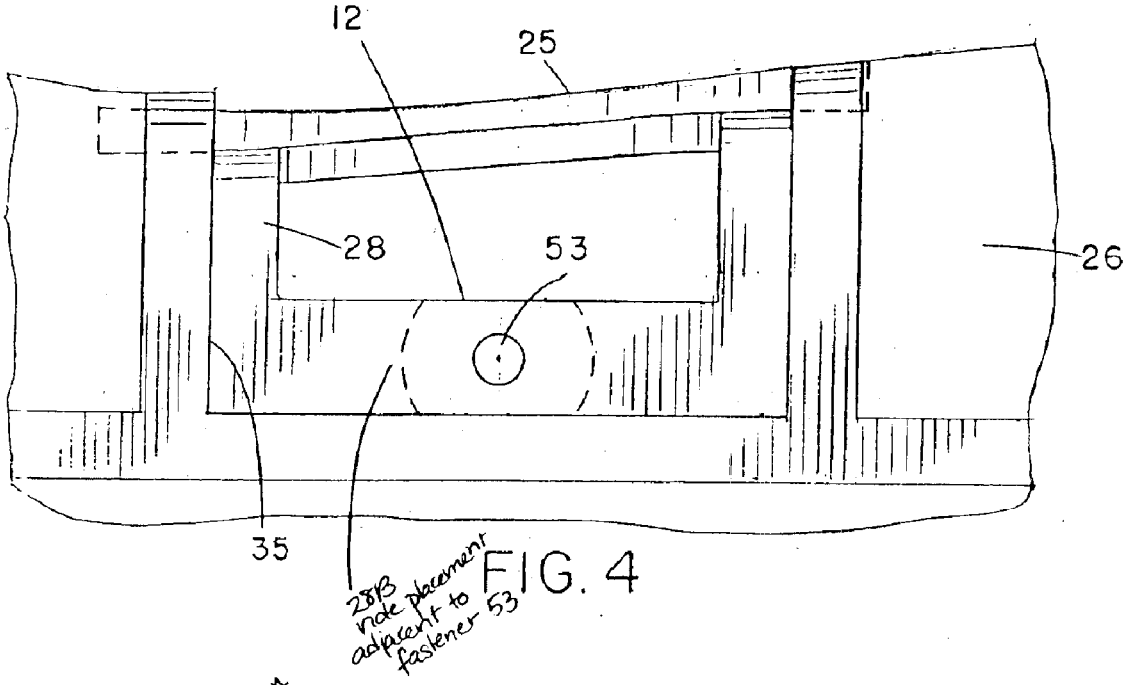
FIG. 4 is an enlarged bottom plan view of the boot socket configured to receive the backside plate.
Figure 5:
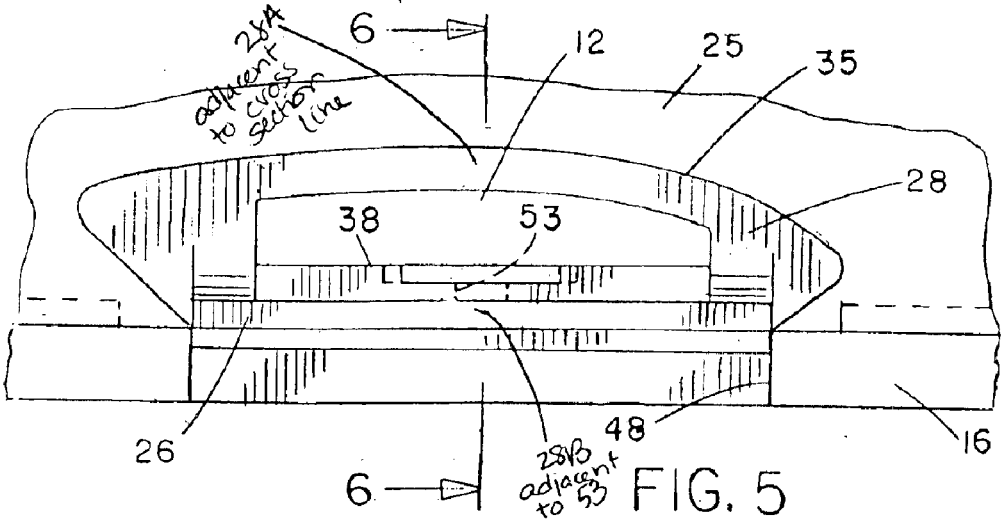
FIG. 5 is a side view of the structure of FIG. 4.

The backslide plate 10 is made of a suitable durable, smooth-surfaced material designed to resist abrasion when the skater uses the plate to slide against a suitable grinding edge such as the edge of a sidewalk, a rail, or the like. The plate 10 may be made of strong plastic material, which is relatively lightweight, or alternatively of metal such as aluminum or steel. As best illustrated in FIGS. 1, 7 and 8, the plate 10 has two generally perpendicular legs 22,24 designed to fit in the opening 12 which extends over a lower part of the outer side face 25 of the boot and into the sole 26 of the boot. The opening 12 has a recessed peripheral rim 28, as best illustrated in FIGS. 1 and 3 to 5. The inner surfaces of the legs 22,24 have a raised portion 30 of L-shaped cross-section extending over the junction between the two legs which is of predetermined shape and dimensions for fitting into opening 12, and a flat peripheral rim 32 extending around portion 30, with the outer periphery 34 of rim 32 matching the shape and dimensions of the periphery 35 of the recessed rim 28 in the boot. Thus, the flat peripheral rim 32 mates with the recessed rim 28 surrounding opening 12, while the raised portion 30 fits into opening 12, as best illustrated in FIGS. 2 and 3. When the backslide plate is fitted into the opening, the inner surface 36 of the raised portion 30 will be flush with the adjacent inner surfaces 37,38, respectively of the outer side wall and sole of the boot, as indicated in FIG. 3.

The outer face of the first leg 22 of the backslide plate 10 has a peripheral portion 40 which will be substantially flush with the outer face 25 of the boot side wall when the plate is installed in the recessed boot opening. The outer face of the second leg 24 has a first, generally flat peripheral portion 42 and a stepped outer portion 44 of reduced thickness. A concave, arcuate or curved slide face 45 is formed in the outer face of the plate 10 and extends across the junction between the two legs 22,24. As best illustrated in FIGS. 1 and 2, the curved slide face 45 extends along a major portion of the length of the backslide plate 10, and across a large portion of the outer surface of the legs 22 and 24. This surface forms a guide for a skater for engagement with a suitable sliding edge such as the edge of a curb or a rail, and can be used by a skater to slide against the hard sliding surface when performing maneuvers.

As best illustrated in FIG. 1, the sole plate 16 is designed to be secured against the sole 26 of the boot via fastener bolts extending through respective openings 46 in the sole plate 16 and aligned openings (not illustrated) in the sole 26. The sole plate 16 has an indented, rectangular cut-out 48 in its outer side edge designed to receive part of the lower leg of the backslide plate 10, as indicated in FIGS. 1, 2, 3, and 5. Cut-out 48 has a recessed inner rim portion 49 against which the reduced thickness outer portion 44 of leg 24 is seated when the sole plate is secured to the sole, as indicated in FIGS. 1 and 3. The recessed rim of the sole plate 16 has an indent or opening 50 (see FIG. 1), while the stepped portion 44 of the backslide plate and the sole 26 have aligned openings 52 and 53, respectively, as illustrated in FIGS. 6 and 7. Openings 52 and 53 are aligned with indent 50 when the parts are assembled as indicated in FIG. 3. A fastener bolt 54 is adapted to extend through the aligned openings as indicated in FIG. 3, to engage with a nut 55 at its inner end which is flush with the inner face 38 of the sole of the boot. This secures the backslide plate 10 firmly in the recessed opening 12 since it is sandwiched and gripped between the sole 26 and sole plate 16.

When the parts are assembled and secured together as indicated in FIGS. 2 and 3, the skater will be able to perform sliding maneuvers without damaging the outer surface of the boot, using the arcuate slide face 45 of the backslide plate. At the same time, since the skater's foot can directly contact the inner face 36 of the backslide plate, they will have a better, more direct "feel" of the sliding contact, and will be better able to control the sliding maneuver. The concave slide surface provides a guide to the skater and helps to prevent the skater from sliding off the sliding edge. Thus, this arrangement is an improvement over the prior art where a backslide plate was simply secured on top of an outer surface of the boot, in which case the skater did not directly contact the backslide plate and would have less control.

The single nut and bolt attachment securing the backslide plate in the recessed opening in the boot will make it easy to remove and replace the plate when it becomes too worn. Because the boot surface does not directly contact the edge of a curb or other sliding edge during maneuvers, boot lifetime will be extended. Although the backslide plate 10 is shown installed in a recessed opening in an outer side face of a boot in the exemplary embodiment, it will be understood that a similar backslide plate may also be provided on the inner side face, if sliding along that face is desired. Backslide plates will be installed in recessed openings in the outer face of both the left and right boots to allow the skater to slide with either boot downwards.

The arcuate, extended slide face 45 of the backslide plate 10 will provide a much better slide surface than the edge of a boot, and will also act to guide the skater to maintain an optimum contact between face 45 and the grinding or sliding edge being used during a maneuver. The mounting of the backslide plate in a recessed opening 12 in a boot, rather than on the outside of the boot, immediately brings the slide face 45 closer to the skater's foot, as well as providing more direct feel and contact with the foot. This should result in improved control and performance.

Figure 9:
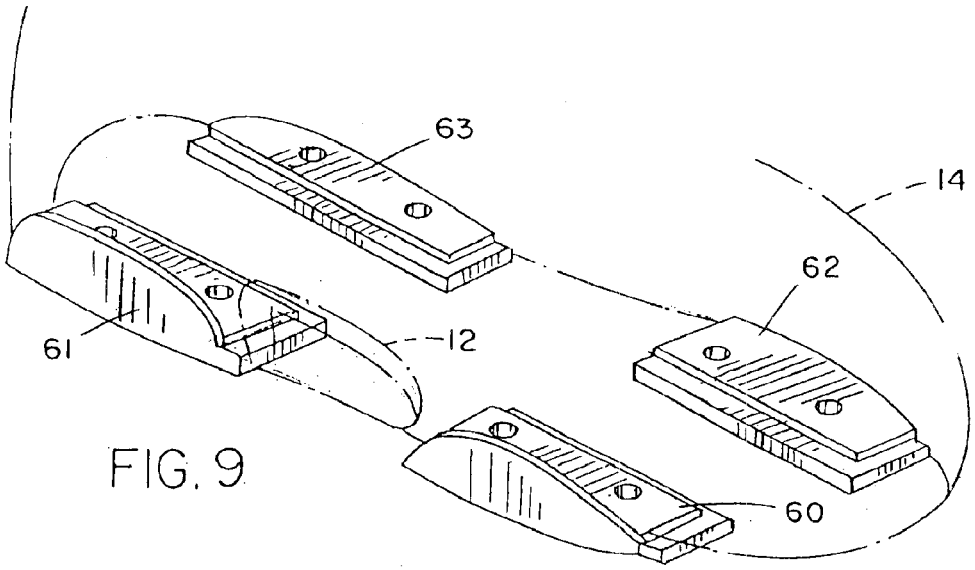
FIG. 9 is a perspective view illustrating separate grind plates for replacing the sole plate of FIG. 1.

FIG. 9 illustrates a modification in which the sole plate 16 of FIG. 1 is replaced by separate grind plates 60, 61, 62, and 63. The first two grind plates 60 and 61 are secured to the sole adjacent the outer side edge of the boot on opposite sides of recessed opening 12. Backslide plate will be secured in opening 12 in exactly the same way as in FIGS. 1 to 8. Grind plates 62 and 63 will be secured to the sole along the inner edge of the boot, each aligned with a respective one of the outer grind plates. The backslide plate 10 in this case will operate in exactly the same manner as in the previous embodiment.

In the illustrated embodiments, the backslide plate extends along about one third of the length of the boot. However, in alternative embodiments, the backslide plate may be extended in length. Regardless of the overall dimensions, the backslide plate is generally located in an opening extending across the center of the boot side face.

Although an exemplary embodiment of the invention has been described above by way of example only, it will be understood by those skilled in the field that modifications may be made to the disclosed embodiment without departing from the scope of the invention, which is defined by the appended claims.

I claim:

1. An in-line skate assembly, comprising:

a boot having a sole, a heel, a toe, and opposite inner and outer side faces, the boot having an opening in its outer side face adjacent to and extending partially into the sole;

a backslide plate for mating engagement in the boot opening, the backslide plate having an arcuate outer slide guiding surface for contacting a sliding surface during sliding maneuvers;

a releasable fastener device for releasably securing the backslide plate in the boot opening;

a separate sole plate and fastener means for releasably securing the sole plate to the sole of the boot, the sole plate having a cut-out aligned with said backside plate; and the backslide plate having a lower portion which extends into the cut-out in said sole plate.

2. The assembly as claimed in claim 1, including a first pair of spaced grind plates secured to the sole of the boot adjacent the outer side face on opposite sides of said backside plate, and a second pair of grind plates secured to the sole of the boot at spaced locations adjacent the inner face of the boot.

3. The assembly as claimed in claim 1, wherein the opening has an outwardly facing, recessed peripheral rim of reduced thickness, and the backslide plate has an outer, inwardly facing flat rim extending around its periphery for seating against the rim of said opening.

4. The assembly as claimed in claim 1, wherein the backslide plate has an outer surface including said arcuate slide surface, the outer surface also having a peripheral portion extending around said arcuate slide surface, the peripheral portion being substantially flush with the adjacent outer surface portions of said outer side wall and sole of said boot.

5. The assembly as claimed in claim 1, wherein the backslide plate comprises a plate member having first and second generally perpendicular legs for fitting in an opening cut into a skater's boot at the junction between an outer side face and sole of the boot;

the first leg having an outer face with a portion which is substantially flush with the outer side face of the boot when the plate is fitted in the opening;

the second leg having an outer face with a portion which faces downwardly adjacent the sole of the boot when fitted in the opening; and the arcuate outer slide guiding surface comprising an outwardly facing, smooth, concave arcuate sliding surface portion extending across the junction between the two outer faces for forming a sliding surface for performing sliding or grinding maneuvers.

6. An in-line skate assembly, comprising:

a boot having a sole, a heel, a toe, and opposite inner and outer side faces, the boot having an opening in its outer side face adjacent to and extending partially into the sole;

a backslide plate for mating engagement in the boot opening, the backslide plate having an arcuate outer slide guiding surface for contacting a sliding surface during sliding maneuvers;

a releasable fastener device for releasably securing the backslide plate in the boot opening;

a separate sole plate and fastener means for releasably securing the sole plate to the sole of the boot, the sole plate having a cut-out aligned with said backslide plate;

the sole of said boot, said sole plate, and the backslide plate having aligned opening, and said fastener device extending through said aligned openings to secure said backslide plate between said sole plate and the sole of the boot.

7. The assembly as claimed in claim 6, wherein the boot is of predetermined length and the opening extends over substantially a mid-point in the length of the boot, the opening having a length equal to at least one third of the length of the boot.

8. An in-line skate assembly, comprising:

a boot having a sole, a heel, a toe, and opposite inner and outer side faces, the boot having an opening in its outer side face adjacent to and extending partially into the sole;

a backslide plate for mating engagement in the boot opening, the backslide plate having an arcuate outer slide guiding surface for contacting a sliding surface during sliding maneuvers;

a releasable fastener device for releasable securing the backslide plate in the boot opening; and the opening has a first portion in the side of said boot and a second portion extending into said sole, and the backslide plate is a member of generally L-shape cross-section having a first leg located in the first portion of said opening and a second leg located in the second portion of said opening.

9. An in-line skate assembly, comprising:

a boot having a sole, a heel, a toe, and opposite inner and outer side faces, the boot having an opening in its outer side face adjacent to and extending partially into the sole;

a backslide plate for mating engagement in the boot opening, the backslide plate having an arcuate outer slide guiding surface for contacting a sliding surface during sliding maneuvers;

a releasable fastener device for releasably securing the backslide plate in the boot opening;

the opening having an outwardly facing, recessed peripheral rim of reduced thickness, and the backslide plate having an outer, inwardly facing flat rim extending around its periphery for seating against the rim of said opening; and said rims having at least one pair of aligned holes, and said fastener device extending through said holes to releasably secure said backslide plate in said opening.

10. An in-line skate assembly comprising:

a boot having a sole, a heel, a toe, and opposite inner and outer side faces, the boot having an opening in its outer side face adjacent to and extending partially into the sole;

a backslide plate for mating engagement in the boot opening, the backslide plate having an arcuate outer slide guiding surface for contacting a sliding surface during sliding maneuvers;

a releasable fastener device for releasably securing the backslide plate in the boot opening; and the backslide plate has an outer surface having a first portion forming a continuation of the outer side face of said boot and a second portion generally perpendicular to said first portion forming a continuation of said sole, and a junction between said first and second portions, said outer slide guiding surface comprising a smooth concave indent extending across said junction and over at least part of said first and second outer surface portions.

11. The assembly as claimed in claim 10, wherein the backslide plate and boot have inner surfaces, the inner surface of said backslide plate forming a smooth, substantially flush continuation of the inner surface of the boot at the junction between the outer side wall and sole of the boot.

12. The assembly as claimed in claim 10, wherein the second portion has a fastener opening for releasably securing the backslide plate in the boot opening.

13. The assembly as claimed in claim 10, wherein the backslide plate has an inner face having a raised portion of generally L-shaped cross-section for fitting into the opening in a boot at the junction between the side wall and sole of the boot, and a peripheral rim extending around said raised portion for location against a peripheral recessed rim of the boot opening.

14. The assembly as claimed in claim 12, wherein the member backslide plate has an extended flange extending around at least part of its periphery for extending under the sole of the boot adjacent the opening, and the fastener opening is located in said flange.

* * * * *